United States Patent [19]

Provence

[11] Patent Number: 4,930,233

[45] Date of Patent: Jun. 5, 1990

[54] SKI BOOT

[75] Inventor: Marc Provence, Thorens-les-Glieres, France

[73] Assignee: Salomon S.A., Annecy Cedex, France

[21] Appl. No.: 305,056

[22] Filed: Feb. 2, 1989

[30] Foreign Application Priority Data

Feb. 2, 1988 [FR] France ..... 88 01183

[51] Int. Cl.[5] ..... A43B 5/04; A63C 9/20

[52] U.S. Cl. ..... 36/117; 280/615

[58] Field of Search ..... 36/117–121; 280/615

[56] References Cited

U.S. PATENT DOCUMENTS 4,309,833 1/1982 Salomon ..... 36/117
4,334,367 6/1982 Salomon ..... 36/117

FOREIGN PATENT DOCUMENTS 169429 1/1986 European Pat. Off. ..... 36/117
3334144 4/1984 Fed. Rep. of Germany ..... 36/117
2556569 6/1985 France ..... 36/117
WO87/06486 11/1987 World Int. Prop. O. .
WO87/06802 11/1987 World Int. Prop. O. .
WO88/05271 7/1988 World Int. Prop. O. .

*Primary Examiner*—James Kee Chi
*Attorney, Agent, or Firm*—Pollock, Vande Sande & Priddy

[57] ABSTRACT

Cross-country ski boot whose sole, made of a molded plastic material, carries, at its front end, a transverse fastening axis which cooperates with a binding mounted on the cross-country ski. A part (*6a*) of the anchoring element (6), which is embedded in the plastic material of the front portion of the sole (2), extends along a plane (P) sloping upward from back to front, and the transverse fastening axis is located on the lower portion of the anchoring element (6). The sole (2) has, immediately behind the fastening device (4), a recess (*2a*) which marks off, on the upper portion of the sole (2), an area (*2b*) of reduced thickness constituting the equivalent of a hinge for the sole (2).

14 Claims, 3 Drawing Sheets

SKI BOOT

FIELD OF THE INVENTION

The present invention concerns a cross-country ski boot whose molded plastic sole carries, at its front end, a transverse fastening axis cooperating with a binding mounted rn a cross-country ski. This transverse fastening axis is unitary with an anchoring element embedded, either wholly or in part, in the casting-molded plastic material of the sole.

BACKGROUND OF THE INVENTION

Cross-country ski-boots in which the fastening axis, which provides for connection with the binding borne by the ski, is unitary with an anchoring element extending rearward horizontally or substantially horizontally within the front portion of the sole, are already well known. A device of this kind is described, for example, in patent application No. EP-0 169 429. Because this anchoring element extends over a significant length within the front portion of the sole, the anchoring element gives additional rigidity to this front portion. This arrangement constitutes a major disadvantage, since the cross-country ski boot must provide a certain flexibility to the front end of its sole, so as to allow the boot to be raised and lowered successively during cross-country skiing.

SUMMARY OF THE INVENTION

The present invention attempts to remedy this disadvantage by providing for a cross-country ski-boot which is equipped, on the front portion of the sole, with an anchoring element arranged in such a way as to allow the creation of a hinge which allows the boot to pivot.

For this purpose, this cross-country ski boot, whose sole, made of a molded plastic material, carries at its front end a fastening device having a transverse fastening axis which cooperates with a binding mounted on a cross-country ski and unitary with an anchoring element embedded totally or partially in the casting-molded plastic material of the sole, is characterized by the fact that the portion of the anchoring element which is embedded in the plastic material of the front portion of the sole extends along a plane sloping upward from the back to front, and the transverse fastening axis is located on the lower part of the anchoring element.

BRIEF DESCRIPTION OF THE DRAWINGS

In order that the invention may be more clearly understood, several embodiments thereof will now be described with reference to the accompanying drawings, wherein.

DESCRIPTION OF THE PREFERRED EMBODIMENTS

Figure 1:
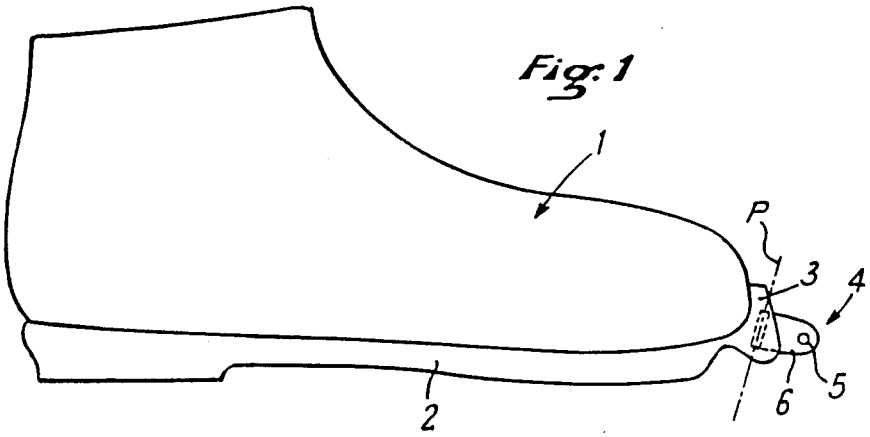
FIG. 1 is aside elevation view of a cross-country ski boot which, at its front end, is equipped with a fastening device according to the invention.

FIG. 1 shows a cross-country ski boot 1 having a sole 2 made of a molded plastic material, which has, on the front end of the boot 1, a swelling or added thickness 3 on which a fastening device 4 is mounted. This fastening device 4 is designed to work in conjunction with a binding mounted on a cross-country ski, in order to bind the front of the boot 1 to the ski and to allow the rear portion of this boot to be freely raised during cross-country skiing.

Figure 2:
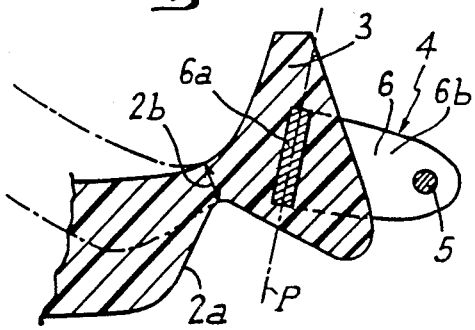
FIG. 2 is a vertical, longitudinal cross-section, on a larger scale, of the front end portion of the sole of the boot in FIG. 1.

The fastening device 4 comprises a horizontal and transverse fastening axis 5 which is unitary with an anchoring element 6. In this embodiment of the invention, this anchoring element 6 appears as a dome having a core 6*a* (FIG. 2) embedded in the plastic material making up the front swelling 3, and two wings 6*b* extending forward and perpendicular to the core 6*a*. The transverse fastening axis 5 extends horizontally between the front end portions of the two wings 6*b*, i.e., at a certain distance from the outside surface of the swelling 3. The connection between the fastening device 4 and the swelling 3 of the sole 2 is achieved by embedding the core 6*a* and the portions of the wings 6*b* attaching these wings to the core 6*a*, in the plastic material making up the sole 2.

According to the invention, the core 6*a* of the 6 making up the anchoring element of the fastening device 4 extends along plane P sloping upward from back to front, in such a way that the wings 6*b*, in turn, slope downward. The angle of inclination of plane P of the core 6*a* in relation to a vertical, transverse plane is relatively slight, i.e., on the order of from 10° to 30°. Because of this inclination, the fastening axis 5 is located on the lower end of the dome-shaped anchoring element 6.

Because of such an arrangement of the anchoring element 6, the front portion of the sole 2 may be formed in such a way as to incorporate, immediately behind the fastening device 4, a recess 2*a* which marks off an area 2*b* of reduced thickness in the upper portion of the sole 2. This area 2*b* constitutes the equivalent of a hinge, thereby allowing the sole 2 to be very easily flexed at this point when the boot pivots upward, as is shown by dot-dash lines in FIG. 2. This area 2*b* of least thickness produces no effect on the arrangements which hold in place the anchoring element 6, whose core 6*a*, and the portions of the wings 6b in proximity to the core 6, are embedded in the plastic material and held firmly in position by this material.

Figure 3:
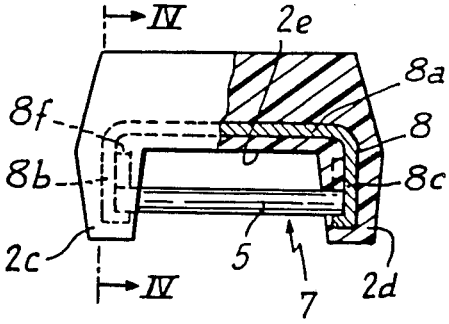
FIG. 3 is a frontal view, in partial vertical and longitudinal cross-section, of another embodiment of the fastening device of the boot.
Figure 4:
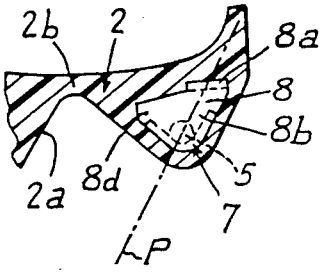
FIG. 4 is a vertical and longitudinal cross-section taken along the line IV—IV in FIG. 3.
Figure 5:
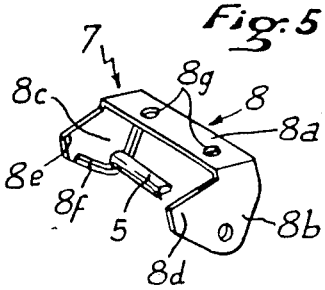
FIG. 5 is a perspective view of the fastening device shown in FIGS. 3 and 4.

In the embodiment of the invention shown in FIGS. 3 to 5, the sole 2 has, on its lower surface, a longitudinal groove 2e, across which passes, in the front part of this groove, the horizontal, transverse fastening axis 5 of a fastening device 7. The fastening axis 5 of the fastening device 7 is unitary with an anchoring element 8 made up of a dome-shaped metallic part comprising a substantially horizontal upper core 8a embedded in the plastic material and extending transversely above the bottom of the groove 2e. This core 8a is extended downward at its two ends by two wings 8b, 8c sloping upward and from back to front along plane P, each of which is completely embedded in the plastic material making up the two parts 2c, 2d of the sole formed on either side of the longitudinal groove 2e. The two wings 8b, 8c may take any shape whatever, and may, in particular, be extended rearward by respective rear tabs 8d, 8e which may or may not be coplanar with the wings 8b, 8c, thus having a substantially triangular shape with the point aimed downward, as shown in FIGS. 4 and 5. The two wings 8b, 8c have, in the area of their lower ends, concentric holes drilled through them, through which the ends of the transverse fastening axis 5 are engaged and fastened. The two wings 8b, 8c may be rigidified by the inner edges 8d, folded back to form a square, which increase the surface area adhering by contact to the plastic material. Holes 8g may also be drilled in the core 8a and/or in the wings 8b, 8c, in order to improve the bonding to the molded plastic material.

Figure 6:
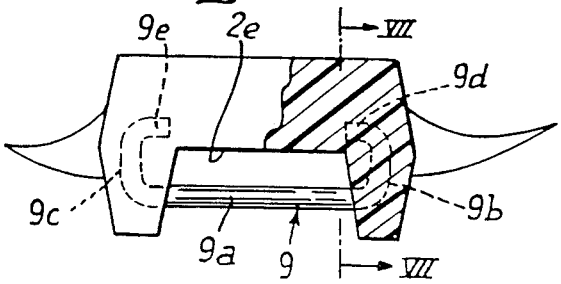
FIG. 6 is a frontal view, in partial vertical and transverse section, of another embodiment of the fastening device according to the invention.
Figure 7:
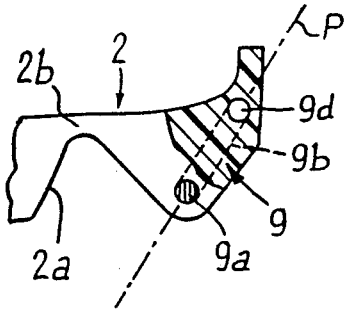
FIG. 7 is a vertical and longitudinal section taken along the line VII—VII shown in FIG. 6.
Figure 8:
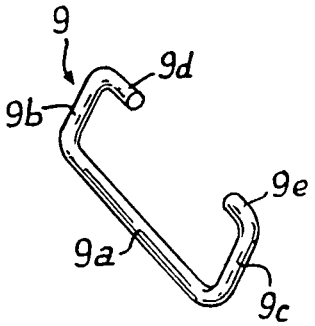
FIG. 8 is a perspective view of the C-shaped element of the fastening device shown in FIGS. 6 and 7.

In the embodiment shown in FIGS. 6 through 8, the fastening device 9 comprises a single part, made of metal wire, which is cut and arched in the shape of a C. This part 9 comprises a core 9a making up the fastening axis of the device; this core is extended at its two ends by two arms bent to form a square 9b, 9c, which extend in the same direction and whose ends are made up of short arms 9d, 9e bent back toward each other. This fastening device 9 is partially embedded in the plastic material making up the front portion of a sole 2 having a longitudinal groove 7. The fastening axis 9a extends transversely and horizontally across the groove 7, as may be seen in FIG. 6, while the arms 9b, 9c and the terminating arms 9d, 9e are embedded in the plastic material, so as to ensure that the device 9 is anchored. Here again, the plane P of the fastening device 9 (FIG. 7) slopes upward and from back to front, and the fastening axis is located on the lower portion of the fastening device 9.

Figure 9:
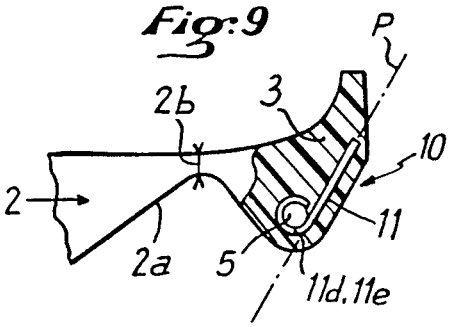
FIG. 9 is a vertical and longitudinal section of another embodiment of the fastening device.
Figure 10:
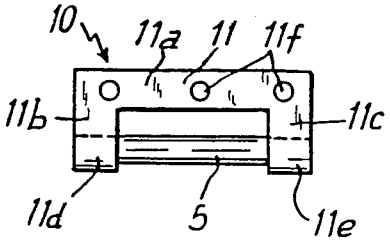
FIG. 10 is an elevated view of the fastening device shown in FIG. 9.
Figure 11:
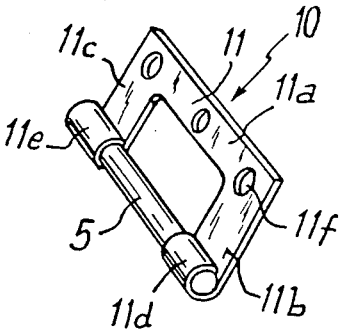
FIG. 11 is a perspective view of the fastening device shown in FIGS. 9 and 10.

In the embodiment shown in FIGS. 9 to 11, the fastening device 10 is made up of a sheet-metal plate 11 cut out in the shape of a U and having an upper core 11a and two wings 11b, 11c perpendicular to this core and extending downward. The lower end pieces 11d, 11e of the two wings 11b, 11c are wound around the end pieces of the fastening axis 5, in order to hold it firmly in place. As in the embodiments shown in FIGS. 3 to 8, the core 11a and the two wings 11b, 11c are completely embedded in the plastic material forming the swelling 3, and the fastening axis 5 extends across a longitudinal groove in the sole 2. Holes 11f are, advantageously, drilled in the core 11a and/or in the wings 11b, 11c, in order to facilitate the connection with the molded plastic material. Here once again, the plane P of the sheet-metal plate 11 making up the anchoring element slopes upward from back to front, thereby allowing the formation of the area 2b of least thickness behind the swelling.

Figure 12:
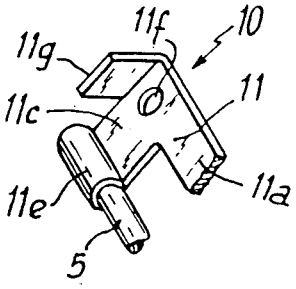
FIGS. 12 and 13 are partial perspective views of embodiments of the fastening device shown in FIGS. 9 to 11.

In the embodiment shown in FIG. 12, the core 11a of the U-shaped sheet-metal plate 11 is extended, at each of its ends, by a tab 11g perpendicular to this core 11a, so as to increase the anchoring surface area in contact with the molded plastic material.

Figure 13:
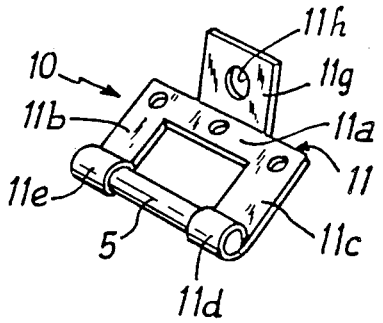

In the embodiment shown in FIG. 13, the core 11a of the sheet-metal plate 11 has, on its upper edge, a vertical extension comprising a central tab 11g which is coplanar with the core 11a, or which forms an obtuse angle with the core. This tab 11g may have at least one hole 11h drilled in it, which receives the rivet effecting the bonding with the front end of the boot upper.

Figure 14:
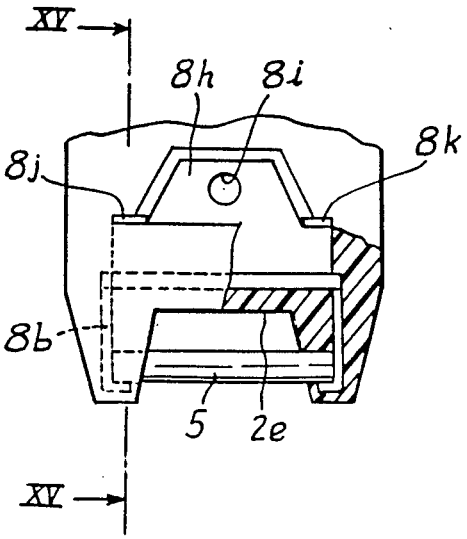
FIG. 14 is a frontal view, in partial transverse section, of another embodiment of the fastening device.
Figure 15:
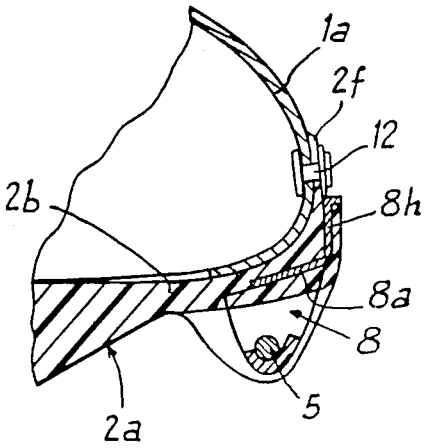
FIG. 15 is a section along the line XV—XV shown in FIG. 14.

In the embodiment shown in FIGS. 14 and 15, the core of the anchoring element 8 of the fastening device 7 has, in the central portion of its front edge, a vertical extension comprising a tab 8h, substantially vertical, which forms an obtuse angle with the core 8a. This tab 8h is embedded in the lower portion of the plastic material of the sole, while its upper portion projects upward on the outside of the plastic material, immediately in front of the front end of the boot upper and of a front portion 2f of the sole 2 which rises upward. The upper portion of the tab 8b has a hole 8i drilled through it, in which is engaged the connecting rivet 12 that passes through the rising portion 2f of the sole and the front end 1a of the boot upper. The tab forming a vertical extension 8h also has, on either side of the central portion through which the hole 8i is drilled, two edges forming a square 8j, 8k which extend forward, immediately above the upper edge of the mass of plastic material in which the tab 8h is partially embedded. These two edges 8j, 8k, which protrude on the outside of the plastic material of the sole 2, form means of attachment which, in conjunction with the fastening axis 5, cooperate with the binding mounted on the ski.

What is claimed is:

1. Cross-country ski boot having a sole of molded plastic material, said sole carrying, on its front end, fastening device having a transverse fastening axis, said fastening device cooperating with a binding mounted on a cross-country ski, said transverse fastening axis being unitary with an anchoring element embedded at least partially in said plastic material of said sole, wherein a part (6a; 8b, 8c; 9b, 9c; 11b, 11c) of said anchoring element (6, 8, 9, 11) embedded in said plastic material of said front end of said sole (2) extends along a plane (P) sloping upward from back to front, and said transverse fastening axis is located at a lower portion of said anchoring element (6, 8, 9, 11).

2. Cross-country ski according to claim 1, wherein said sole (2) has, immediately behind said fastening device (4, 7, 9, 10) a recess (2a) which delimits, in an upper portion of said sole (2), an area (2b) of reduced thickness acting as a hinge for said sole (2).

3. Cross-country skip boot according to claim 1 or 2, wherein said anchoring element (6) is a dome comprising a core (6a) embedded in said plastic material and two wings (6b) extending frontward and perpendicular to said core (6a), while said core (6a) of said dome (6) extends along the plane (P) sloping upward from back to front, in such a way that said wings (6b), in turn, slope downward, and that said fastening axis (5) is located at said lower end of said dome-shaped anchoring element (6).

4. Cross-country ski boot according to claim 1 or 2, wherein said sole (2) has, in a lower surface thereof, a longitudinal groove (2*e*) across a front portion of which extends said horizontal and transverse fastening axis (5) of said fastening device (7), wherein said fastening axis (5) is unitary with an anchoring element (8) comprising a dome-shaped metal part with a substantially horizontal upper core (8*a*) which is embedded in said plastic material and extending transversely above a bottom of said groove (2*e*), said core (8*a*) being extended downward at its two ends by two wings (8*b*, 8*c*) sloping upward from back to front along said plane (P), each of said wings being completely embedded in said plastic material constituting two parts (2*c*, 2*d*) of said sole formed on either side of said longitudinal groove (2*e*), and having, adjacent to their lower ends, concentric holes, in which said ends of said transverse fastening axis (5) are positioned and fastened.

5. Cross-country ski boot according to claim 4, wherein said two wings (8*b*, 8*c*) are extended rearward by respective rear tabs (8*d*, 8*e*), so as to form a substantial triangle with an apex aimed of said triangle pointed downward.

6. Cross-country ski boot according to claim 4, wherein said two wings (8*b*, 8*c*) are rigidified by inner edges (8*d*) of said wings folded back to form a square.

7. Cross-country ski boot according to claim 1 or 2, wherein said fastening device (10) is constituted by a sheet-metal plate (11) cut out in the shape of a U and having an upper core (11*a*) and two wings (11*b*, 11*c*), perpendicular to said core, which extend downward, while lower end portions (11*d*, 11*e*) of said two wings (11*b*, 11*c*) are wound around end-pieces of said fastening axis (5).

8. Cross-country ski boot according to claim 7, wherein a core (11*a*) of said sheet-metal plate (11) is extended, at each of its ends, by a tab (11*g*) which is perpendicular to said core (11*a*).

9. Cross-country ski boot according to claim 4, wherein a core (8*a*, 11*a*) of said anchoring element (8, 11) comprises at least one vertical extension (8*h*, 11*g*) projecting from a front end of the boot.

10. Cross-country ski boot according to claim 9, wherein said vertical extension (8*h*) comprises fastening means (8*j*, 8*k*) associated with said fastening axis (5) so as to cooperate with a binding mounted on said ski.

11. Cross-country ski boot according to claim 9, wherein said vertical extension (8*h*, 11*g*) has at least one hole (8*i*, 11*h*) through which a rivet (12) is positioned connecting with a front end (1*a*) of an upper of said boot.

12. Cross-country ski boot according to claim 4, wherein holes (8*g*, 11*f*) are drilled in said core (8*a*, 11*a*) and/or in said wings (8*b*, 8*c*; 11*b*, 11*c*).

13. Cross-country ski boot according to claim 1 or 2, wherein said fastening device (9) comprises a single part, made of metal wire, which is cut out and arched in the shape of a C, said part (9) having a core (9*a*) constituting said fastening axis of the device, said core being extended at its two ends by two arms folded to form a square (9*b*, 9*c*) and extending in the same direction, and whose ends are constituted by short arms (9*d*, 9*e*) curved toward each other.

14. Cross-country ski boot according to claim 10, wherein said vertical extension (8*h*, 11*g*) has at least one hole (8*i*, 11*h*) through which a rivet (12) is positioned connecting with a front end (1*a*) of an upper of said boot.

* * * * *